US007048457B2

(12) United States Patent
Harris

(10) Patent No.: US 7,048,457 B2
(45) Date of Patent: May 23, 2006

(54) DOCUMENT DELIVERY SYSTEM APPARATUS AND METHOD

(75) Inventor: Richard H. Harris, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 85 days.

(21) Appl. No.: 10/373,141

(22) Filed: Feb. 24, 2003

(65) Prior Publication Data

US 2004/0165928 A1 Aug. 26, 2004

(51) Int. Cl.
*B65H 29/12* (2006.01)
*B41J 13/08* (2006.01)

(52) U.S. Cl. ..... 400/635; 271/186; 271/303; 271/225

(58) Field of Classification Search ..... 271/186, 271/303, 902, 225; 400/578, 594.1, 600.3, 400/616.3, 637.3, 625, 629
See application file for complete search history.

(56) References Cited

U.S. PATENT DOCUMENTS

| | | | | | |
|---|---|---|---|---|---|
| 4,056,263 | A * | 11/1977 | LaWhite et al. | ..... | 271/3.2 |
| 4,265,175 | A * | 5/1981 | Smejda | ..... | 101/115 |
| 4,297,039 | A | 10/1981 | Lees | ..... | 400/120 |
| 4,842,263 | A * | 6/1989 | Robertson | ..... | 271/186 |
| 4,846,057 | A * | 7/1989 | Endo et al. | ..... | 101/120 |
| 5,048,416 | A * | 9/1991 | Iijima | ..... | 101/115 |
| 5,050,858 | A * | 9/1991 | Nakamura | ..... | 271/265.01 |
| 5,317,377 | A * | 5/1994 | Rubscha et al. | ..... | 399/401 |
| 5,588,762 | A | 12/1996 | Suzuki | ..... | 400/582 |
| 5,657,976 | A | 8/1997 | Cohen et al. | ..... | 270/1.02 |
| 5,727,471 | A * | 3/1998 | Iwafune et al. | ..... | 101/477 |
| 5,913,513 | A | 6/1999 | Surya | ..... | 271/272 |
| 5,921,686 | A | 7/1999 | Baird et al. | ..... | 400/68 |
| 5,938,354 | A | 8/1999 | Yasui et al. | ..... | 400/621 |
| 5,954,438 | A | 9/1999 | Klein et al. | ..... | 400/621 |
| 6,056,460 | A | 5/2000 | Suzuki | ..... | 400/621 |
| 6,149,327 | A | 11/2000 | Ward et al. | ..... | 400/582 |
| 6,227,532 | B1 * | 5/2001 | Bakoledis | ..... | 271/9.13 |
| 6,341,777 | B1 * | 1/2002 | Carter | ..... | 271/291 |
| 6,612,570 | B1 * | 9/2003 | Cox | ..... | 271/279 |
| 6,769,682 | B1 * | 8/2004 | Sumi et al. | ..... | 271/186 |

* cited by examiner

*Primary Examiner*—Daniel J. Colilla
(74) *Attorney, Agent, or Firm*—Kunzler & Associates

(57) ABSTRACT

A document delivery device for delivering a document such as a receipt or transaction record to a user at a kiosk or other automated device significantly reduces "pushing" of documents, increasing reliability and robustness. The document delivery device includes input and output roller assemblies that alternately engage and disengage a shared roller. Upon contacting the shared roller, the input roller assembly creates a first nip point to draw a document into a retention location. Likewise, an output roller creates a second nip point to draw a document out of the retention location for presentation to a user. The input and output roller assemblies are coupled together such that the rotation of one produces an opposite rotation of the other. A drive gear may be operably connected to the roller assemblies to drive the rotation thereof and to provide the translational force to engage or disengage the shared roller.

18 Claims, 6 Drawing Sheets

DOCUMENT DELIVERY SYSTEM APPARATUS AND METHOD

BACKGROUND OF THE INVENTION

1. The Field of the Invention

The invention relates to devices, methods, and systems for the reliable delivery of documents. Specifically, the invention relates to devices, methods, and systems for the reliable delivery of documents to users at kiosks or other automated devices.

2. The Relevant Art

Kiosks have become an integral part of many services provided in today's marketplace. The use of kiosks provides increased efficiency, lower cost, better service, lower requirements for human labor, and the like. Many companies use kiosks to provide services such as automated telling, self-service checkout at grocery stores, gift registries, information booths, ticket dispensers, telephone and internet access, and the like.

In addition to increased efficiency, kiosks may also provide additional convenience and faster service by taking advantage of computer automation. In many instances, a kiosk or other automated device is significantly more reliable and less error prone than a human attendant. For example, various studies in the financial industry have shown that automated teller machines produce significantly fewer errors than human tellers. Kiosks may also provide services to people at remote locations where traditional services are unavailable.

Kiosks are often placed at locations where a user is free to operate the kiosk with little supervision or visibility from a merchant. Thus, good kiosk design requires that a unit be as reliable as possible. The components of a kiosk must be very dependable and every possible means of operator-induced failures must be eliminated where possible.

Printers in kiosks are particularly vulnerable to operator-induced failures. A common instance of failure occurs when a user of a kiosk attempts to retrieve a receipt or other document before the printing is complete, thereby causing a paper jam. Several kiosk printer manufacturers have addressed this mode of failure by designing a mechanism known as a presenter.

A presenter protects a printer from hostile or untrained users and allows a printer to complete printing of a document before a user of a kiosk can retrieve it. When printing is complete, the document is fed to the presenter. The presenter then proceeds to deliver the document to the user very rapidly, providing very little time or reason to retrieve the document before it is fully available.

Several different methods are used in presenter mechanisms to accumulate the printed document from the printer, before presenting the document to a user. Some mechanisms allow a document to loop before presentation, while others use methods for coiling a document before presentation. Nevertheless, the majority of known methods require that a document be pushed a significant distance before a loop or coil is created.

For example, one prior art method uses a "looping" approach. This approach requires that a document be pushed across a "bridge" until a leading end of the document is stopped. Once the document has fully spanned the "bridge," additional document length is accommodated by allowing the document to buckle.

Another prior art method uses a "coiling" approach. In this approach, a document is pushed into a coiling cage. When printing of the document is complete, an entrance to the cage is flipped to a position opposite the exit slot of the enclosure where the feed is reversed and the document is presented to the customer.

Those skilled in printer design understand that a printer mechanism that pushes a document is far less reliable than one that does not push a document. Therefore, it would be desirable to provide a document delivery device that greatly reduces the distance that a document is pushed. Thus, a document delivery device is described herein that is directed to improving the reliability of a kiosk or other automated device designed to deliver documents.

Another type of presenter 10 shown in FIG. 1 diverts a receipt 11 or other document 11 in a downward direction, without looping, into an enclosure 14. In order to present the document 11 to a user, the presenter reverses the direction of the document 11 to feed the document past a flap diverter 12. This action directs the document 11 out of the enclosure 14.

The mechanism 10 allows a receipt 11 or other document 11 to be partially extended or completely ejected as needed according to the application. Although the mechanism 10 is simple in design and inexpensive to manufacture, it suffers from several significant reliability problems.

First, the flap diverter 12 is subject to document snags. These snags may be caused by various document characteristics, such as an uneven cut or wrinkles. Furthermore, if a document 11 is thin, or the humidity is high, the document may be exposed to buckling or jamming as it is pushed or diverted by the flap 12, or pushed around the curves 16, 18. One manufacturer, in particular, has attempted to minimize these exposures by ensuring that the flap 12 is thin and flexible. However, making the flap 12 thin and flexible exposes the flap 12 to wear and damage.

Since the flap 12 must be extremely smooth to prevent snagging of the leading edge of a document 11, the flap 12 may be secured with adhesive. This adhesive is exposed to failure caused by degradation of the operating environment. Another exposure occurs as the document 11 is fed down into the retention location 14. During this procedure, only gravity is used to ensure that the document 11 drops freely into the retention location 14. Static electricity or some other obstruction can cause a document to be distorted such that it may jam during the presentation process. Thus, another object of the present invention is to maintain control of the document 11 in the retention location 14, thereby greatly reducing some of the previously mentioned problems.

What is needed is a document delivery device that reduces document snags and jams by avoiding, as much as possible, "pushing" of a document, and by maintaining stricter control thereof.

What is further needed is a document delivery device that is simple in design, has a minimum number of moving parts, and uses more reliable mechanisms for document delivery.

What is further needed is a document delivery device that can accommodate documents of various lengths, while avoiding problems associated with "looping" or "coiling."

What is further needed is a document delivery device that can release a document into a storage or waste receptacle when a user fails to retrieve the document.

SUMMARY OF THE INVENTION

The various elements of the present invention have been developed in response to the present state of the art, and in particular, in response to the problems and needs in the art that have not yet been fully solved by currently available presenters or document delivery systems. Accordingly, the present invention provides an improved apparatus, method, and system for reliably delivering documents to users at kiosks or other automated stations.

In one aspect of the present invention, an apparatus for delivering a document to a user includes a shared roller that maintains contact with a document as it is received from a printer and as it is transmitted to a user. The document is routed into a retention location where it is temporarily held before being presented to a user or, optionally, the document may be routed from the retention location to a storage or waste receptacle if not retrieved by the user in a timely manner.

An input roller assembly is provided to engage or disengage the shared roller. Upon engaging the shared roller, a first nip point is created to draw a document into the retention location. Likewise, an output roller assembly is provided to selectively engage or disengage the shared roller in an alternating manner with the input roller assembly. The output roller assembly creates a second nip point with the shared roller to draw a document out of the retention location to present it to a user. The input and output roller assemblies are coupled together such that the rotation of one produces an opposite rotation of the other.

In selected embodiments, the input roller assembly includes first and second rollers that are operably connected by a first belt. Likewise, the output roller assembly includes third and fourth rollers operably connected by a second belt. The first and second belts form a retention location that may retain a document by sandwiching it therebetween. The document may be released from the retention location by rotating the input and output roller assemblies in one direction to present the document to a user or, conversely, in the opposite direction to route the document to a waste receptacle. In selected embodiments, the input and output roller assemblies are each simply a single roller.

In one embodiment, a drive gear engages a corresponding gear coupled to one of the roller assemblies in order to drive the document delivery device. However, in other embodiments, the drive gear may drive the document delivery device by driving a gear coupled to the shared roller.

In one selected embodiment, the drive gear may be rotated in a first direction to draw a document into the document delivery device. Similarly, the drive gear may be rotated in a second direction to draw the document out of the document delivery device to present it to a user. Additionally, the rotation of the drive gear in the first direction exerts a tangential force to urge the input roller assembly to engage the shared roller. This produces the first nip point to draw a document into the document delivery device. Upon rotating the drive gear in an opposite direction, an opposite tangential force urges the input roller assembly to disengage the shared roller. Meanwhile, a tangential force urges the output roller assembly to engage the shared roller, thereby creating a second nip point effective to draw a document out of the retention location where it may be presented to a user.

In certain instances, the document delivery device includes at least one sensor to detect various states of the document. For example, a sensor may detect the leading edge of a document as it is drawn into or out of the retention location. A sensor may also detect the trailing edge of a document to ensure that a document is not drawn too far into the document delivery device, where it may be lost in a waste or storage receptacle. A sensor may ensure that a document has been fully routed out of the document delivery device so a user may retrieve it. A sensor may also be effective to detect when a misfeed or paper jam has occurred, and may be used to trigger a reprint of a document or another corrective operation.

If a user has not retrieved a receipt or other document in a timely manner, the document may be drawn back into the document delivery device where it may be routed into a waste or storage receptacle. A sensor may be effective to determine if a document has or has not been retrieved by a user within an allotted time frame.

In another aspect of the present invention, a method for delivering a document to a user includes receiving substantially straightaway, from a printing device, a document at a first nip point. Very little "pushing" of the document is required before the document is more effectively "pulled" into the document delivery device. The first nip point may draw the document into a retention location. The method may further include drawing, by a second nip point, the document out of the retention location, and presenting the document to a user.

The method may further include sensing a status of the document such as the entry of a document into the retention location, the exit of a document from the retention location, a document misfeed, or the like, in order to effectively control the entry and exit of the document. If a user does not retrieve a document in a timely manner, a method in accordance with the invention may further include routing the document from the retention location into a waste receptacle.

In another aspect of the present invention, a method for delivering a document to a user includes providing means for receiving substantially straightaway, from a printing device, a document at a first nip point. The method further includes providing means for drawing the document into a retention location at the first nip point. The method further includes providing means for drawing, at a second nip point, the document out of the retention location at a second nip point, and means for presenting the document to a user.

Means for sensing a status of the document, may also be provided, such as the entry of a document into the retention location, exit of a document from the retention location, a document misfeed, and the like. If a misfeed occurs, or a user does not retrieve a document in a timely manner, the method may further include providing means for selectably routing the document to a waste or storage receptacle.

Various elements of the present invention are combined into a system for delivering a document to a user. For example, a system in accordance with the invention may include a printer for printing a document, a document delivery device to receive the document substantially straightaway, at a first nip point. The system may further include configuring the document delivery device to draw the document into a retention location. Additionally, the system may further include configuring the document delivery device to draw the document out of the retention location, at a second nip point, for presentation to a user.

The various elements and aspects of the present invention provide a novel document delivery device. The present invention increases the reliability of presenting documents to users at kiosks or from other automated devices. These and other features and advantages of the present invention will become more fully apparent from the following description and appended claims, or may be learned by the practice of the invention as set forth hereinafter.

BRIEF DESCRIPTION OF THE DRAWINGS

In order that the manner in which the advantages and objects of the invention are obtained will be readily understood, a more particular description of the invention briefly described above will be rendered by references to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 2 through 8, is not intended to limit the scope of the invention, as claimed, but is merely representative of selected embodiments of the invention.

The illustrated embodiments of the invention will be best understood by reference to the drawings, wherein like parts are designated by like numerals throughout. Those of ordinary skill in the art will, of course, appreciate that various modifications to the processes illustrated in FIGS. 2 through 8 may easily be made without departing from the essential characteristics of the invention. Thus, the following description of FIGS. 2 through 8 is intended only by way of example, and simply illustrates certain selected embodiments of processes that are consistent with the invention as claimed herein.

Figure 1:
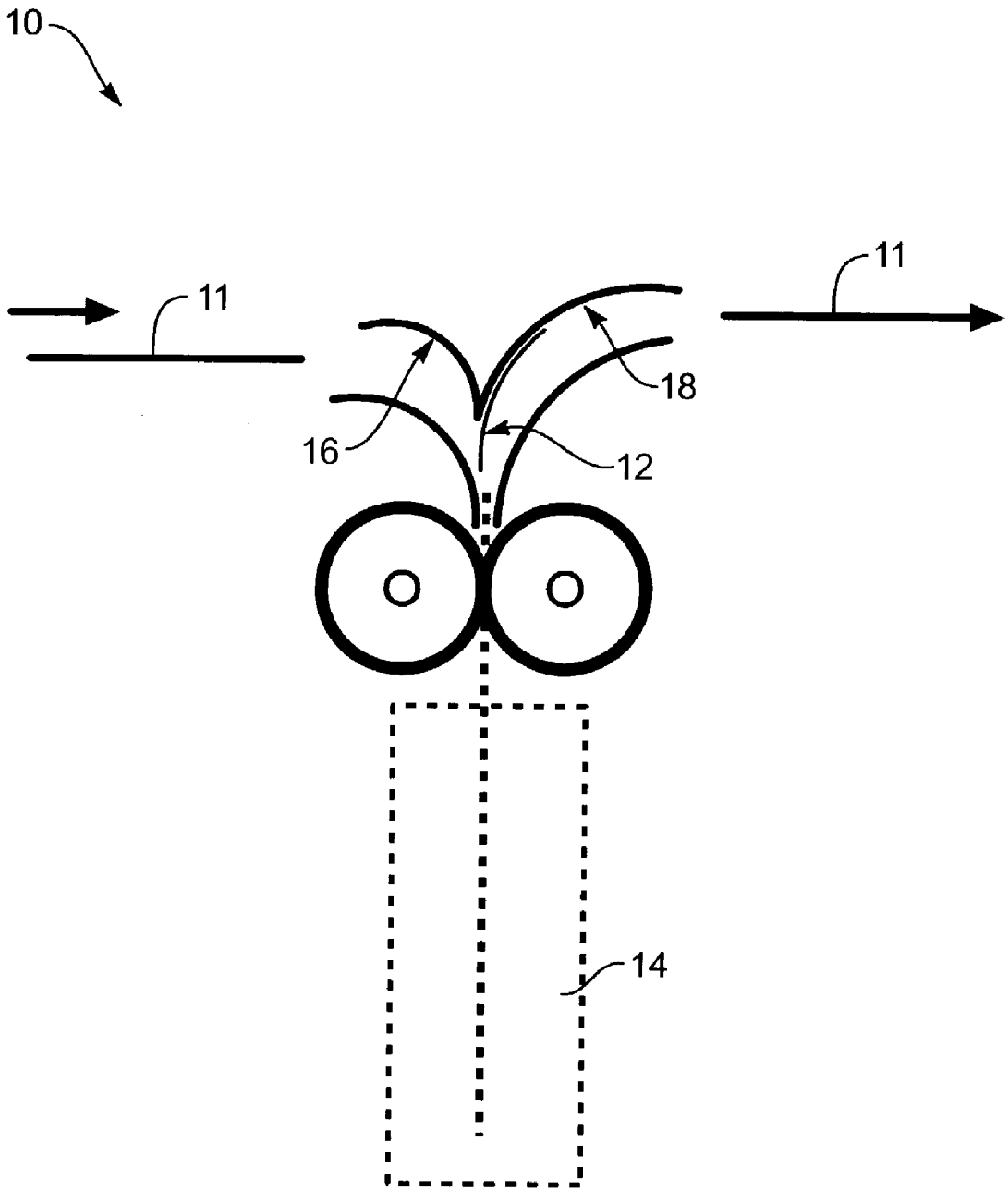
Prior Art FIG. 1
FIG. 1 is a cross-sectional view illustrating one embodiment of a prior art device that requires significant "pushing" of a document.
Figure 2:
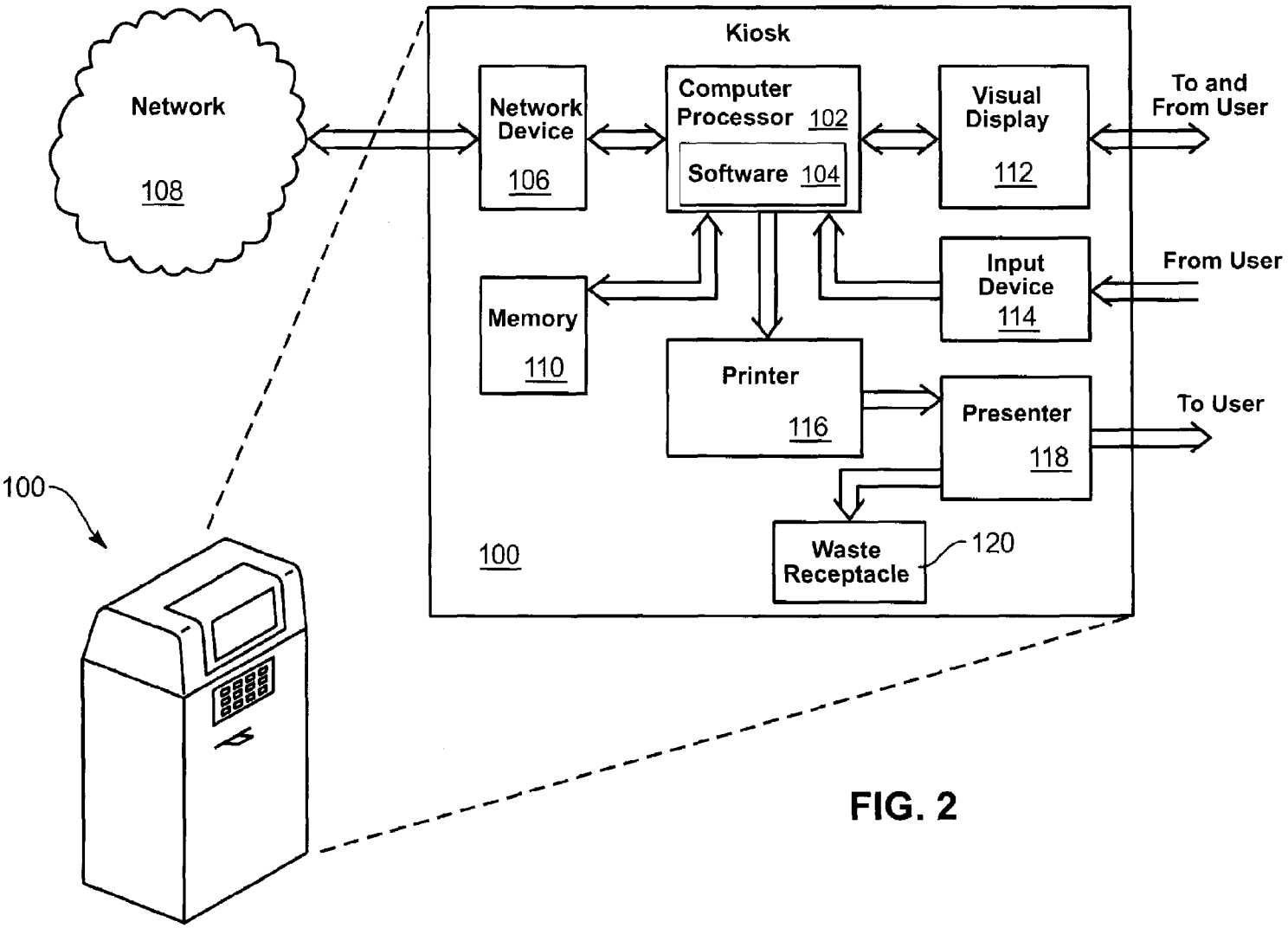
FIG. 2 is a schematic block diagram illustrating one embodiment of a kiosk that may be used in accordance with the present invention.

Referring to FIG. 2, a kiosk 100 or other automated device 100 may include a variety of components to perform various tasks and functions. The kiosk 100 is illustrated to provide an example of one type of device or platform that may be used to implement an apparatus and method in accordance with the invention and is not intended to limit the scope of the present invention. In fact, apparatus and methods in accordance with the invention may be used in a wide variety of different devices, such as in home or commercial printers, copiers, fax machines, scanners, or other applications where the reliable delivery of documents (e.g., paper) is a priority. Additionally, the present invention need not be limited to paper products, but may also be applied to process a wide variety of flexible sheet materials, such as plastics, cardboards, metals, and the like, whether printed or not.

In certain embodiments, a kiosk 100 may be an independent stand-alone device, or may be a device integrated into another structure such as a wall, building, vehicle, or the like. A kiosk 100 may contain a wide variety of different components. For example, in selected embodiments, a kiosk 100 may include a computer processor 102 to store, retrieve, process data, arbitrate between software and hardware components, and the like, within the kiosk 100. The kiosk 100 may include a network device 106, such as a network card 106, which may communicate with a network 108 to transmit or receive data.

The computer 102 may also execute selected software modules 104 that may be stored in memory 110 residing in the kiosk 100, or downloaded across the network 108. The kiosk 100 may include a visual display 112 that may be used to display information or, in some cases, act as an input device 112 to receive data from a user. An input device 114, such as a keypad, card reader, or the like, may be provided to receive data and instructions from a user.

Many kiosks 100 provide a printed receipt or other document to a user in order to provide a record of a transaction or other pertinent information. Thus, a printer 116 may be used to print and deliver documents to a user. Because a printer has a comparatively larger quantity of moving parts than other components within a kiosk 100, a printer 116 may be more prone to failure. Such failures may render a kiosk 100 nonfunctional for its intended purpose. Therefore, increasing the reliability of a printer 116 or other document delivery system 116 may significantly increase the overall reliability of the kiosk 100.

Additional problems have been experienced when users of a kiosk 100 attempt to retrieve a receipt or other document before it has finished printing and fully exited a printer 116, thereby causing a paper jam or misfeed. Once such an event occurs, the kiosk 100 may be rendered nonfunctional until a misfeed is removed and the problem is corrected. In order to reduce this problem, the presenter 118 was developed.

The presenter 118 acts as an interface between the printer 116 and a user. Because the presenter 118 does not perform many of the complicated functions of a printer 116, a presenter 118 can present a document to a user much faster. Thus, while a user may be tempted to retrieve a document from a printer 116 before the document has finished printing, a presenter 118 may present a document before a typical user has time to react. Thus, occurrences of a user retrieving a document before it is fully ready for retrieval may be greatly reduced, if not altogether eliminated.

If a document is presented but not retrieved by a user, the presenter 118 may include a feature for retrieving a document where it may be discarded or stored in a secure receptacle. Thus, sensitive information may be withheld from those for whom it is not intended and, as an added benefit, unretrieved documents may be retained so as not to create unwanted litter.

Figure 3:
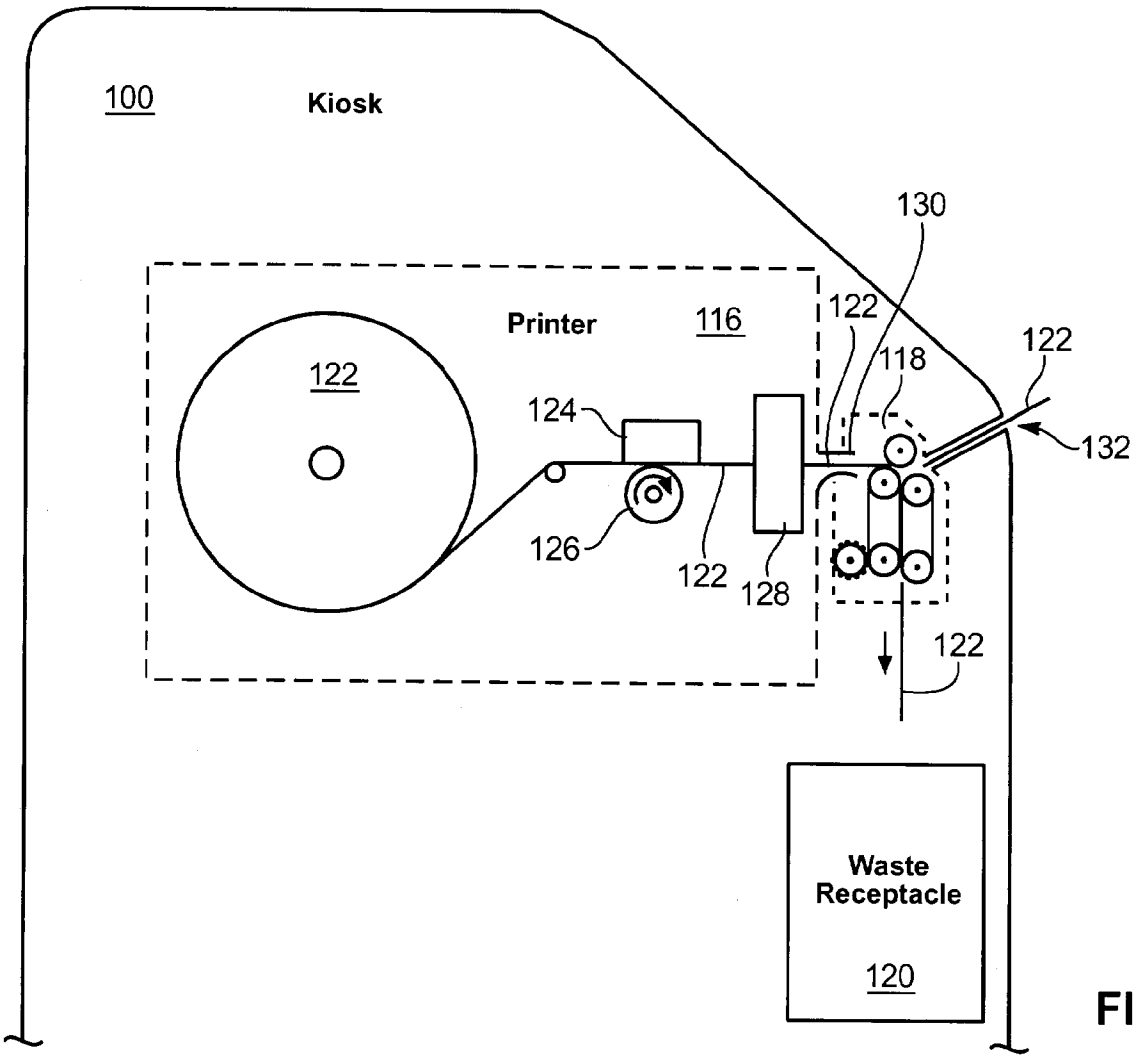
FIG. 3 is a cross-sectional view illustrating one embodiment of a document delivery device working in conjunction with a printer.

Referring to FIG. 3, a printer 116 may perform various functions in the process of creating a document. For example, paper 122 may be provided on a roll 122 or, optionally, in plain precut form. The paper 122 may be fed to a printing head 124 where print is actually applied to the paper 122. A platen 126 may be used to apply pressure to the paper 122 to keep it pressed against the printing head 124.

Once printed, the paper may be fed from the printer 116 and cut by a cutting device 128. As the paper is fed from the printer 116, a document delivery device 118 in accordance with the invention is positioned to receive the paper 122 such that very little "pushing" is required. The document delivery device may be positioned very closely to the paper output 130 of the printer 116. Moreover, the document delivery device 118 may receive the document directly from the printer 116, without any portion of the document being "pushed" around a curve.

The document delivery device 118 in the depicted embodiment routes the document 122 to an opening 122 in the kiosk 100 for presentation to a user. If a user does not retrieve the document 122 in a timely manner, or it is determined that the document is not needed, the document 122 may be discarded or transferred to a waste receptacle 120.

Figure 4:
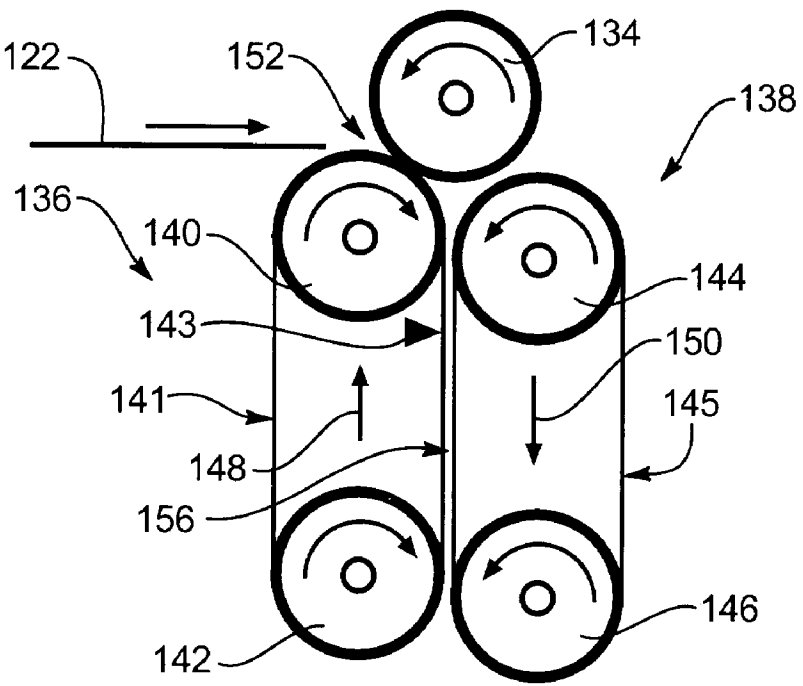
FIG. 4 is a cross-sectional view illustrating one embodiment of a roller assembly creating a nip point to draw a document into the document delivery device.

Referring to FIG. 4, in one embodiment, a document delivery device 118 includes a plurality of rollers 134, 140, 142, 144, 146. A first set of rollers 140, 142 are connected by a belt 141 to create an input roller assembly 136. A second set of rollers 144, 146 are connected by a second belt 145 to create an output roller assembly 138. The input roller assembly 136 may include a frame (not shown) to maintain a fixed distance between the rollers 140, 142, to maintain adequate and constant tension in the belt 141. Likewise, the output roller assembly 138 may include a similar frame.

The roller 134 and belts 141, 145 are constructed of a material having a coefficient of friction sufficient to grip a target document 122. Alternatively, the roller assemblies 136, 138 may be embodied as single rollers 140, 144. However, in such embodiments, an alternative method for retaining the document 122 is needed. Likewise, in this embodiment, the rollers 140, 144 are constructed to have a coefficient of friction sufficient to grip a target document 122. In general, any surface that is used to grip or engage the surface of a document 122 is constructed of a material having a suitable coefficient of friction.

To draw a document 122 into the document delivery device 116, the input roller assembly 136 is urged in a direction 148 to contact a shared roller 134. The input roller assembly 136 rotates with the shared roller 134 to create a first nip point 152 that, upon receiving a document 122, draws the document into a retention location 156 between the two belts 141, 145. Meanwhile, the output roller assembly 138 is urged in a direction 150 opposite of that of the input roller assembly 136 to disengage the output roller assembly 138 from the shared roller 134.

Because the output roller assembly 138 is rotating in a direction opposite to that of the input roller assembly 136, the document 122 is guided into the retention location 156 between the belts 141, 145. Since the two belts 141, 145 are in close contact, a document 122 may be securely held therebetween until it is routed out of the document delivery device 118 to a user, or to a waste receptacle 120.

In selected embodiments, the document delivery device 118 may include one or more sensors 143 to detect various states of the document 122. The sensors 143 contribute to effectively routing documents in and out of the device 118, as well as to detect document misfeeds or jams. The sensor 143 may be used to detect the leading or trailing edge of documents 122 entering or exiting the device 118. Thus, the device 118 may be configured to effectively monitor a document 122, and device failures can thereby be detected so that corrective measures may be taken.

In one embodiment, the sensor 143 detects when the trailing edge of a document 122, entering the device 118, reaches the sensor 143. The roller assemblies 136, 138 may then stop rotating to prevent the document from being routed into the waste receptacle 120. The rotation of the roller assemblies 136, 138 may then be reversed to deliver a document 122 out of the document delivery device 118 to a user.

Figure 5:
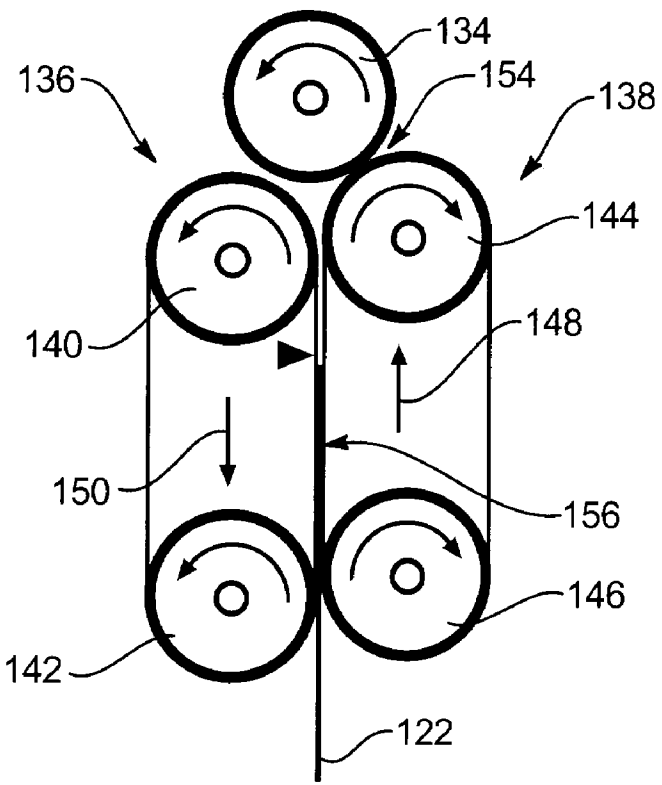
FIG. 5 is a cross-sectional view illustrating one embodiment of a roller assembly creating a nip point to route a document out of the document delivery device for presentation to a user.

Referring to FIG. 5, once a document 122 is within the retention location 156, the document 122 may be routed out of the document delivery device 118 to a user. To accomplish this, the position of the roller assemblies 136, 138 relative to the shared roller 134 may be reversed. The roller assembly 136 may be moved in a direction 150 to disengage it from the shared roller 134. Meanwhile, the roller assembly 138 may be moved in the opposite direction 148 to engage the shared roller 134 to create a second nip point 154. Because of the rotation of the rollers 134, 144, 146, the document is guided out of the retention location 156 through the nip point 154 where it may be presented to a user.

Since the roller assemblies 136, 138 are configured to move in the directions 148, 150, the rollers 140, 142, 144, 146 may be mounted in slotted holes to permit this movement. The actual length of the slotted holes may be varied according to the application. However, one of ordinary skill in the art will recognize that the length of the slotted holes may be relatively small, the main object thereof being to allow the contact and separation of the roller assemblies 136, 138 from the shared roller 134.

Figure 6:
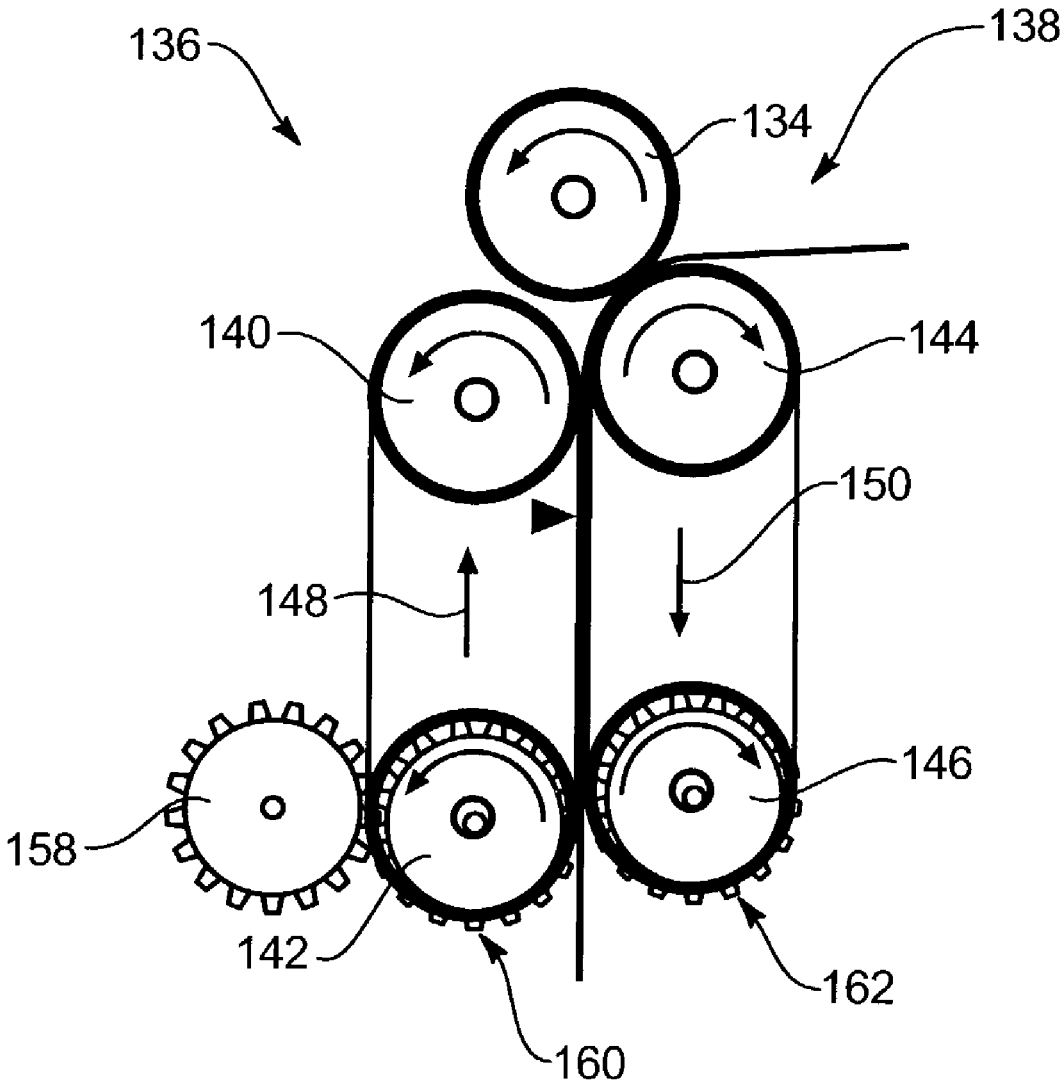
FIG. 6 is a cross-sectional view illustrating one embodiment of a drive gear used to power the document delivery device.

Referring to FIG. 6, in one embodiment, a drive gear 158 is used to drive the document delivery device 118. For example, a drive gear 158 may engage a gear 160 coupled to a roller 142 and its corresponding roller assembly 136. The gear 160 may engage another gear 162 that drives the roller 146 and its corresponding roller assembly 138. Thus, a rotation of the input roller assembly 136 induces an opposite rotation of the other roller assembly 138.

In another embodiment, the drive gear 158 may be positioned to drive gears coupled to one of the rollers 140, 144 to drive the document delivery device 118. In yet another embodiment, a drive gear 158 drives the shared roller 134. In this embodiment, although not as simple or elegant as the previously mentioned examples, a separate mechanism is provided to translate the roller assemblies in the directions 148, 150 to contact the shared roller 134. In yet another embodiment, a motor or other driving means is directly coupled to any of the rollers hereinbefore mentioned to directly drive any of the rollers.

Figure 7:
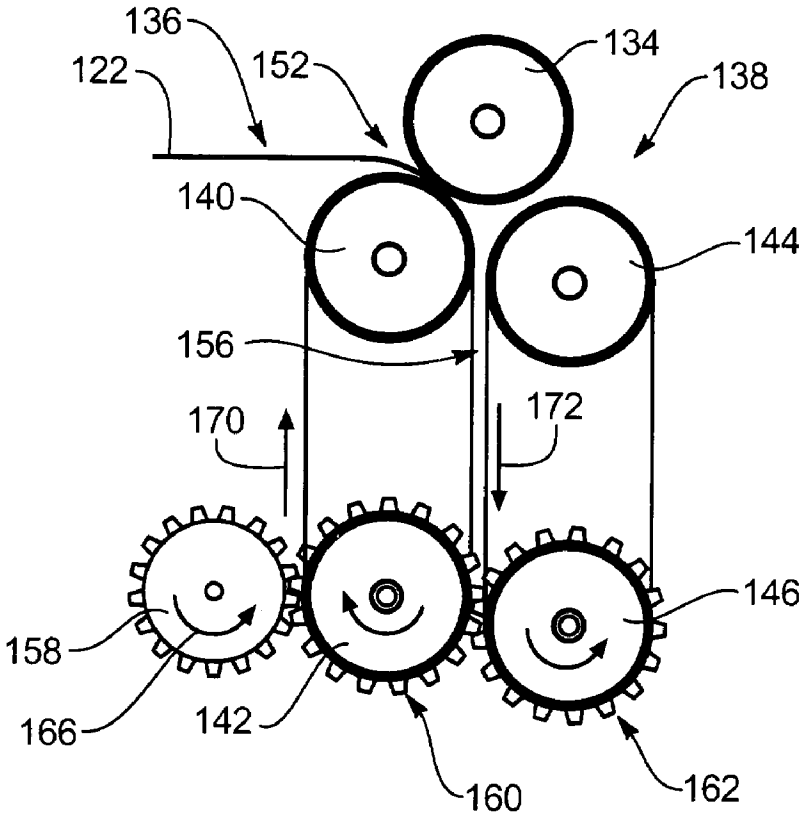
FIG. 7 is a cross-sectional view illustrating one embodiment of a drive gear used to urge the engagement of an input roller assembly with the shared roller in order to draw a document into the document delivery device.

Referring to FIG. 7, in one embodiment, the drive gear 158 also provides the impetus to translate the roiler assemblies 136, 138 to contact the shared roller 134. For example, when the drive gear 158 rotates a first direction 166, a tangential force 170 is also created. This tangential force 170 urges the input roller assembly 36 in a direction 170 to engage the shared roller 134.

In a similar manner, the gear 160 drives the complementary gear 162, which creates a tangential force 172 in the opposite direction of the force 170, thereby urging the output roller assembly 138 away from the shared roller 134. Thus, in the illustrated configuration, with the drive gear 158 rotating in a direction 166, the document delivery device 118 is configured to draw a document into the retention location 156 by way of the nip point 152. Likewise, the same rotation 166 may route a document 122 into a waste receptacle 120.

Figure 8:
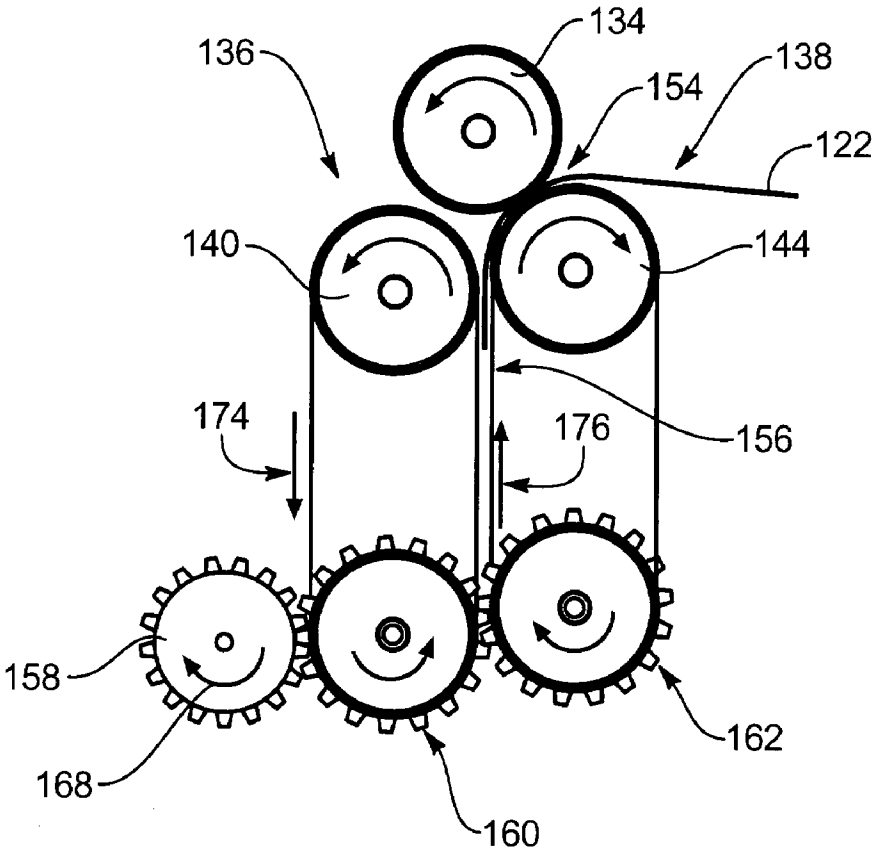
FIG. 8 is a cross-sectional view illustrating one embodiment of a drive gear used to urge the engagement of an output roller assembly with the shared roller in order to draw a document out of the document delivery device for delivery to a user.

Referring to FIG. 8, while continuing to refer generally to FIG. 7, when the drive gear 158 rotates the opposite direction 168, an opposite tangential force 174 is created that urges the input roller assembly 136 away from the shared roller 134. Likewise, the rotation of the gear 160 creates a tangential force 176 that drives the output roller assembly 138 in a direction 176 toward the shared roller 134. This creates a nip point 154 that, is effective to draw a document 122 out of the retention location 156 for presentation to a user. Thus, the drive gear 158 maybe effective not only to drive the rotation of the roller assemblies 136, 138, but may also provide the impetus to move the shared roller assemblies 136, 138 linearly.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for delivering a document to a user, the apparatus comprising:

a shared roller;

an input roller assembly automatically adjustable during operation to selectively engage the shared roller and provide a first nip point to draw a document into a retention position, wherein the input roller assembly comprises first and second rollers operably connected by a first belt; and an output roller assembly automatically adjustable dining operation to selectively engage the shared roller and provide a second nip point to draw the document from the retention position for presentation to a user, wherein the output roller assembly comprises third and fourth rollers operably connected by a second belt.

2. The apparatus of claim 1, wherein the input and output roller assemblies are coupled together such that the rotation of one produces an opposite rotation of the other.

3. The apparatus of claim 1, wherein the retention position is located between the first and second belts such that the document is retained therebetween.

4. The apparatus of claim 1, further comprising a drive gear to drive at least one of the input roller assembly, the output roller assembly, and the shared roller.

5. The apparatus of claim 4, wherein the drive gear is configured to selectably rotate in both a clockwise direction and a counter-clockwise direction.

6. The apparatus of claim 5, wherein:

the input roller assembly is configured to engage the shared roller when the drive gear rotates in a first direction; and the output roller assembly is configured to engage the shared roller when the drive gear rotates in a second direction, opposite the first direction.

7. The apparatus of claim 1, further comprising a sensor to detect a status of the document.

8. The apparatus of claim 7, wherein the status is selected from the group of conditions consisting of entry of a document into the retention location, exit of a document from the retention location, and a document misfeed.

9. The apparatus of claim 1, further comprising a pathway to a waste receptacle, such that the document is routed from the retention location into the waste receptacle in response to a selection by the user.

10. A method for delivering a document to a user, the method comprising:

receiving substantially straightaway, from a printing device, a document at a first nip point;

drawing, by the first nip point, the document into a retention location using an input roller assembly comprising first and second rollers operably connected by a first belt, wherein the input roller assembly is automatically adjustable during operation to selectively engage a shared roller;

drawing, by a second nip point, the document out of the retention location using an output roller assembly comprising third and fourth rollers operably connected by a second belt, wherein the output roller assembly is automatically adjustable during operation to selectively engage the shared roller; and presenting the document to a user.

11. The method of claim 10, further comprising sensing a status of the document.

12. The method of claim 11, wherein the status is selected from the group of conditions consisting of entry of a document into the retention location, exit of a document from the retention location, and a document misfeed.

13. The method of claim 10, further comprising routing the document from the retention location into a waste receptacle in response to a selection by the user.

14. An apparatus for delivering a document to a user, the method comprising:

means for receiving substantially straightaway, from a printing device, a document at a first nip point;

means for drawing, at the first nip point, the document into a retention location using an input roller assembly comprising first and second rollers operably connected by a first belt, wherein the input roller assembly is automatically adjustable during operation to selectively engage a shared roller;

means for drawing, at a second nip point, the document out of the retention location using an output roller assembly comprising third and fourth rollers operably connected by a second belt, wherein the output roller assembly is automatically adjustable during operation to selectively engage the shared roller; and means for presenting the document to a user.

15. The apparatus of claim 14, further comprising means for sensing a status of the document.

16. The apparatus of claim 15, wherein the status is selected from the group consisting of entry of a document into the retention location, exit of a document from the retention location, and a document misfeed.

17. The apparatus of claim 14, further comprising means for routing the document from the retention location into a waste receptacle in response to a selection by the user.

18. A system for delivering a document to a user, the apparatus comprising:

a printer for printing a document;

a document delivery device configured to receive the document substantially straightaway, at a first nip point;

the document delivery device, further configured to draw the document into a retention location using an input roller assembly comprising first and second rollers operably connected by a first belt, wherein the input roller assembly is automatically adjustable during operation to selectively engage a shared roller; and the document delivery device, further configured to draw the document out of the retention location using an output roller assembly comprising third and fourth rollers operably connected by a second belt, wherein the output roller assembly is automatically adjustable during operation to selectively engage the shared roller, at a second nip point, for presentation to a user.

* * * * *

UNITED STATES PATENT AND TRADEMARK OFFICE

CERTIFICATE OF CORRECTION

PATENT NO. : 7,048,457 B2
APPLICATION NO. : 10/373141
DATED : May 23, 2006
INVENTOR(S) : Richard H. Harris It is certified that error appears in the above-identified patent and that said Letters Patent is hereby corrected as shown below:

Column9
Line 29, "adjustable dining operation" should read --adjustable during operation--.

Signed and Sealed this

Seventeenth Day of October, 2006

JON W. DUDAS
*Director of the United States Patent and Trademark Office*